United States Patent [19]

Rivard

[11] Patent Number: 4,794,709

[45] Date of Patent: Jan. 3, 1989

[54] DEVICE FOR DIGGING TRENCHES

[75] Inventor: Daniel Rivard, Daumeray, France

[73] Assignee: ETS. Rivard S. A., Daumeray, France

[21] Appl. No.: 73,716

[22] Filed: Jul. 15, 1987

[30] Foreign Application Priority Data

Oct. 8, 1986 [FR] France ..... 86 14021

[51] Int. Cl.[4] ..... E02F 5/08

[52] U.S. Cl. ..... 37/94; 37/91

[58] Field of Search ..... 37/94, 91, 80 R

[56] References Cited

U.S. PATENT DOCUMENTS 3,394,554 7/1968 Kinnan ..... 37/940 X 3,510,970 5/1970 Mikhailov et al. ..... 37/94

3,933,053 1/1976 Bartels ..... 37/94

3,994,083 11/1976 Cunningham ..... 37/94 X

*Primary Examiner*—David A. Wiecking

*Assistant Examiner*—Moshe I. Cohen

*Attorney, Agent, or Firm*—Fisher, Christen & Sabol

[57] ABSTRACT

The present invention provides a device for digging trenches, including at least one digging wheel with a wheel framework which is connected to a vehicle by means of a mobile carriage for lowering or raising the wheel, further including: first means for causing said digging wheel to pivot about a first pivoting axis orthogonal to the plane defined by the direction of movement of the vehicle and the axis of rotation of said wheel, and second means capable of causing said wheel to pivot about a second pivoting axis orthogonal to the plane defined by said first pivoting axis and an axis parallel to the rotational axis of the wheel.

9 Claims, 4 Drawing Sheets

DEVICE FOR DIGGING TRENCHES

BACKGROUND OF THE INVENTION

The present invention relates to a device for digging trenches.

Devices for digging trenches are already known having at least one digging wheel rotatable about a shaft and having a wheel framework which is connected to a vehicle by means of a mobile carriage for lowering or raising the digging wheel.

Now, although such devices are quite appropriate for digging trenches in a straight line and on flat ground, it is quite otherwise when it is necessary to dig a trench whose axis is deflected with respect to a straight line, for example in a curve, or in the case where the vehicle takes on a certain slant because of unevenesses, in the ground. Thus, in the first case, the curvature of the trench risks being irregular whereas, in the second case, the bottom of the trench risks also being unequal.

In both cases, the laying of cables or similar, for which the trenches thus dug are generally intended, will present difficulties.

The purpose of the present invention is to avoid these drawbacks and provides a device for digging trenches allowing an even trench to be dug perfectly well adapted to the laying of cables or similar, whatever the ground and whatever the path of the vehicle.

SUMMARY OF THE INVENTION

For this, the device for digging trenches, of the above mentioned type, is remarkable in accordance with the invention in that it includes:

first means for causing said digging wheel to pivot in a limited way about a first pivoting axis orthogonal to the plane defined by the direction of movement of the vehicle and the axis of rotation of the wheel, and second means capable of causing said digging wheel to pivot in a limited way about a second pivoting axis orthogonal to the plane defined by said first pivoting axis and an axis parallel to the rotational axis of the wheel.

Thus, it is possible to accurately orientate the digging wheel in space, whatever the unevenesses of the ground, even in a curve.

In particular, said digging wheel may pivot about said first and second pivoting axes through a maximum pivoting angle, each time, between about 10° and about 15° on each side of an intermediate position of the wheel.

According to another characteristic of the invention, said wheel framework is connected to said carriage by an intermediate piece hinged, on the one hand, to said wheel framework about said first pivoting axis and fixed, on the other hand, to the carriage while being able to pivot, in a limited way with respect to said carriage, about said second pivoting axis.

Advantageously, said first pivoting means include a hydraulic cylinder or similar connected to said wheel framework and to said intermediate piece whereas said second pivoting means may include a hydraulic cylinder or similar connected to said intermediate piece and to said carriage.

According to another characteristic of the invention, the device includes means for moving said carriage transversally to the direction of movement of said vehicle.

Advantageously, said means for moving the carriage transversally include a hydraulic cylinder or similar connected to said carriage and to said vehicle.

According to yet another characteristic of the invention, said wheel framework has a general L shape a first leg of which is connected to said carriage through said first pivoting axis and the second leg of which carries the wheel, said first and second legs being hinged to one another through a third pivoting axis parallel to the axis of rotation of the wheel, third pivoting means, formed at least of a hydraulic cylinder or similar, being connectable to the remote ends of said first and second legs.

Finally, to avoid accumulation of earth which would risk clogging up the different shafts, the wheel is provided, in the vicinity of its whole periphery, with angularly spaced bores.

BRIEF DESCRIPTION OF THE DRAWINGS

The Figures of the accompanying drawing will better show how the invention may be constructed. In these Figures, identical references designate similar elements.

DESCRIPTION OF THE PREFERRED EMBODIMENTS

Figure 1:
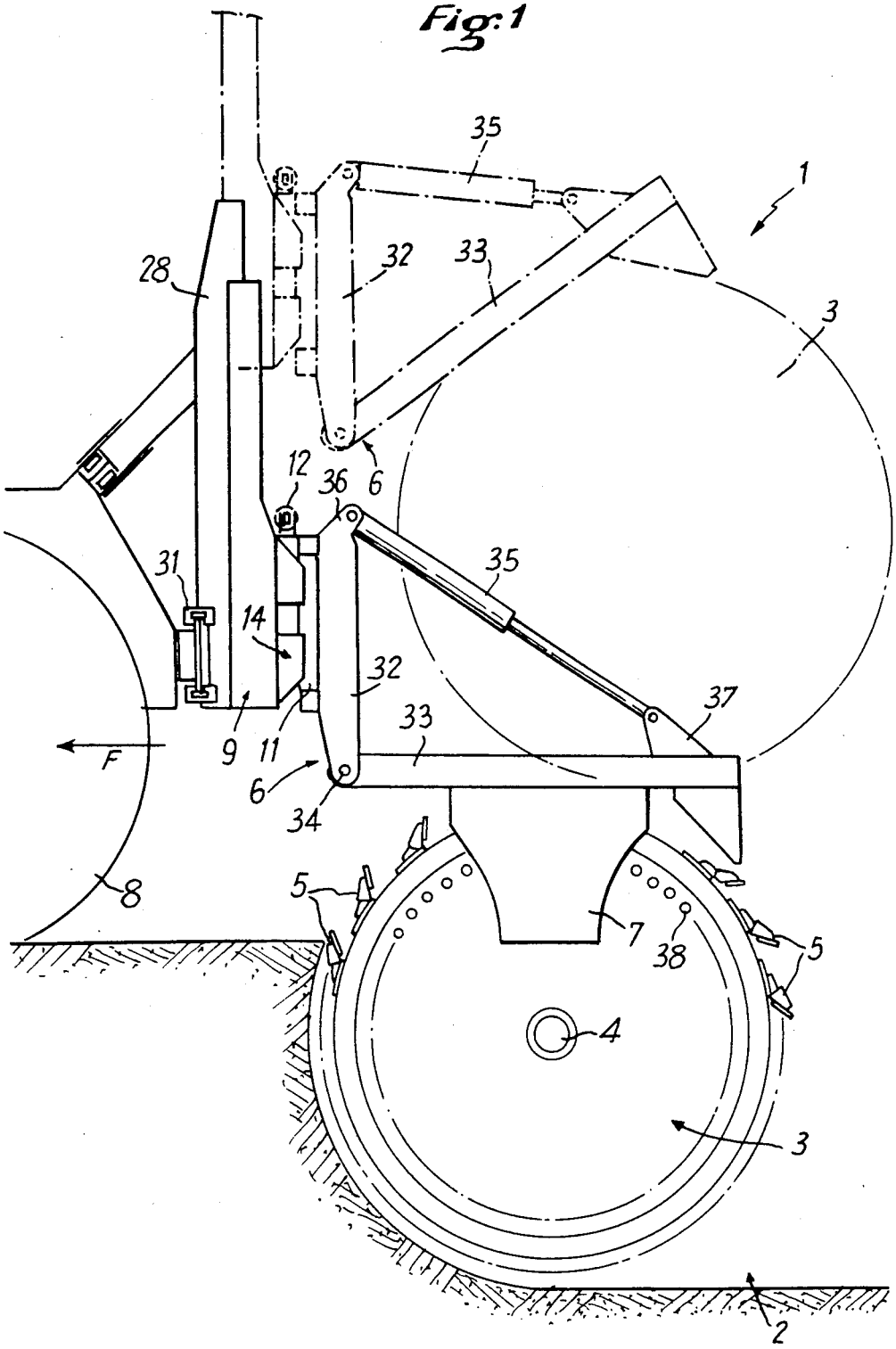
FIG. 1 is a side elevational view of a device of the invention.

The device 1 for digging a trench 2 includes a digging wheel 3 rotatable about a shaft 4 and which has at its periphery a plurality of angularly spaced cutting tools 5.

The digging wheel 3 is mounted under a wheel framework 6 and may be rotated by a motor, not shown, which may be mounted for example on a plate 7 fixing wheel 3 to framework 6.

The wheel framework 6 is connected to a vehicle 8 by means of a mobile carriage 9 allowing the digging wheel 3 to be lowered or raised, the raised position of the wheel being shown with a dot dash line in FIG. 1.

In accordance with the invention, device 1 includes first means, formed in this embodiment, by a hydraulic cylinder 10 able to cause the digging wheel 3 to pivot in a limited way about a first pivoting axis 11 orthgonal to the plane defined by the direction of movement F of vehicle 8 and the axis of rotation 4 of the digging wheel 3, and second means, formed in this embodiment by a hydraulic cylinder 12 capable of causing the digging wheel 3 to pivot in a limited way about a second pivoting axis 13 orthogonal to the plane defined by the first pivoting axis 11 and an axis parallel to the axis of rotation 4 of wheel 3.

Figure 2:
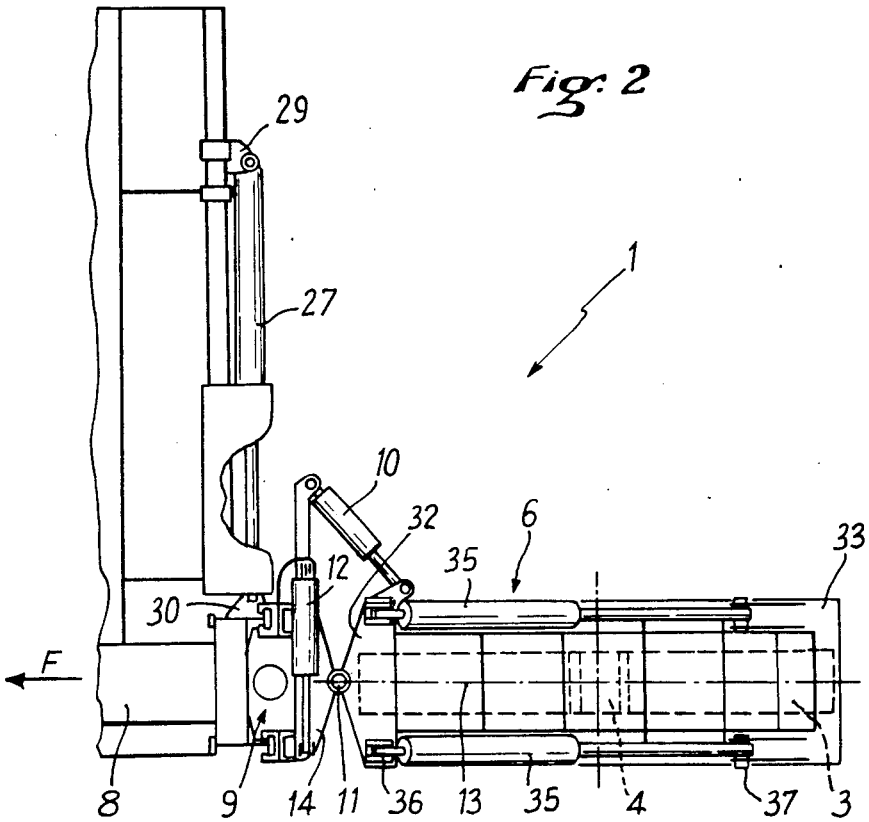
FIG. 2 is a top view of the device of FIG. 1.
Figure 3:
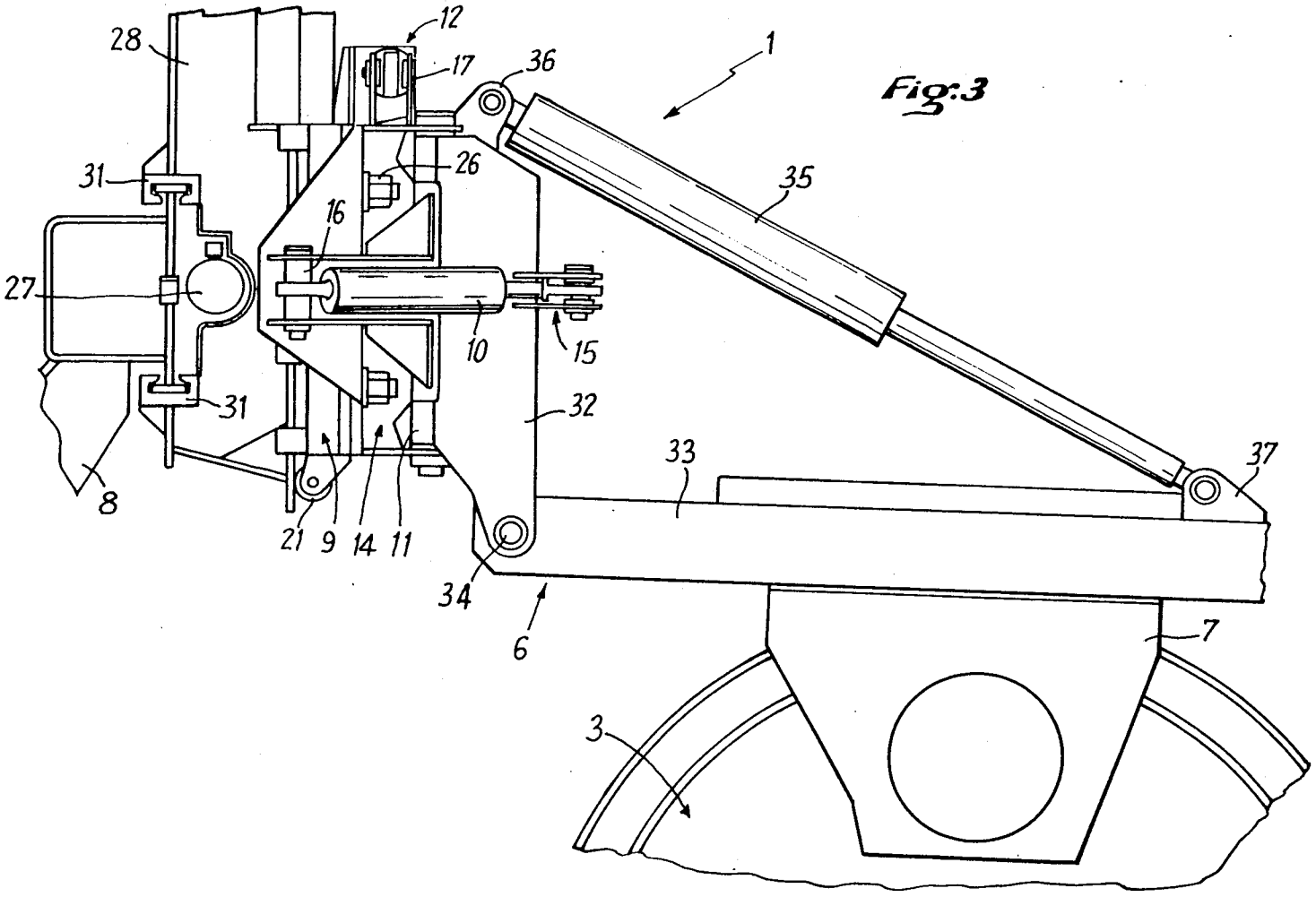
FIG. 3 is a side elevational view of a variant of the device of the invention.

As can be best seen in FIG. 3, in which the hydraulic cylinder 10 is arranged oppositely with respect to the case of FIGS. 1 and 2, the wheel framework 6 is connected to carriage 9 by an intermediate piece 14 hinged, on the one hand, to the wheel framework 6 about the first pivoting axis 11 and fixed, on the other hand, to carriage 9 while being pivotable in a limited way with respect to carriage 9 about the second pivoting axis 13. The fixing of the intermediate piece 14 to carriage 9 will be explained hereafter, in greater detail with reference to FIGS. 4 and 5.

Figure 4:
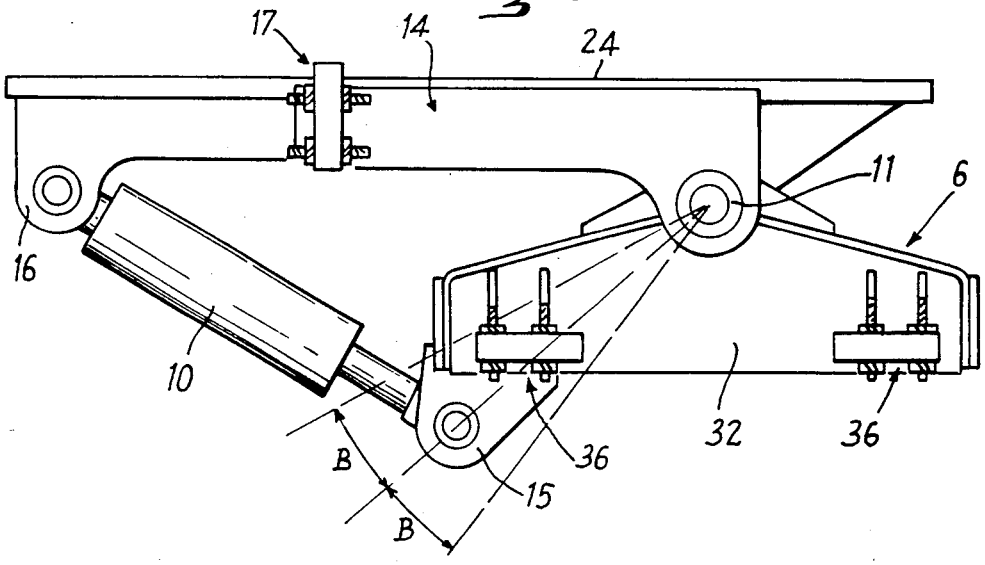
FIG. 4 is a top view of the first means for pivoting the digging wheel.

As can best be seen in FIG. 4, the hydraulic cylinder 10 is connected, on the one hand, to the wheel framework 6 by a bracket 15 and, on the othr hand, to the intermediate piece 14, by a bracket 16.

Figure 5:
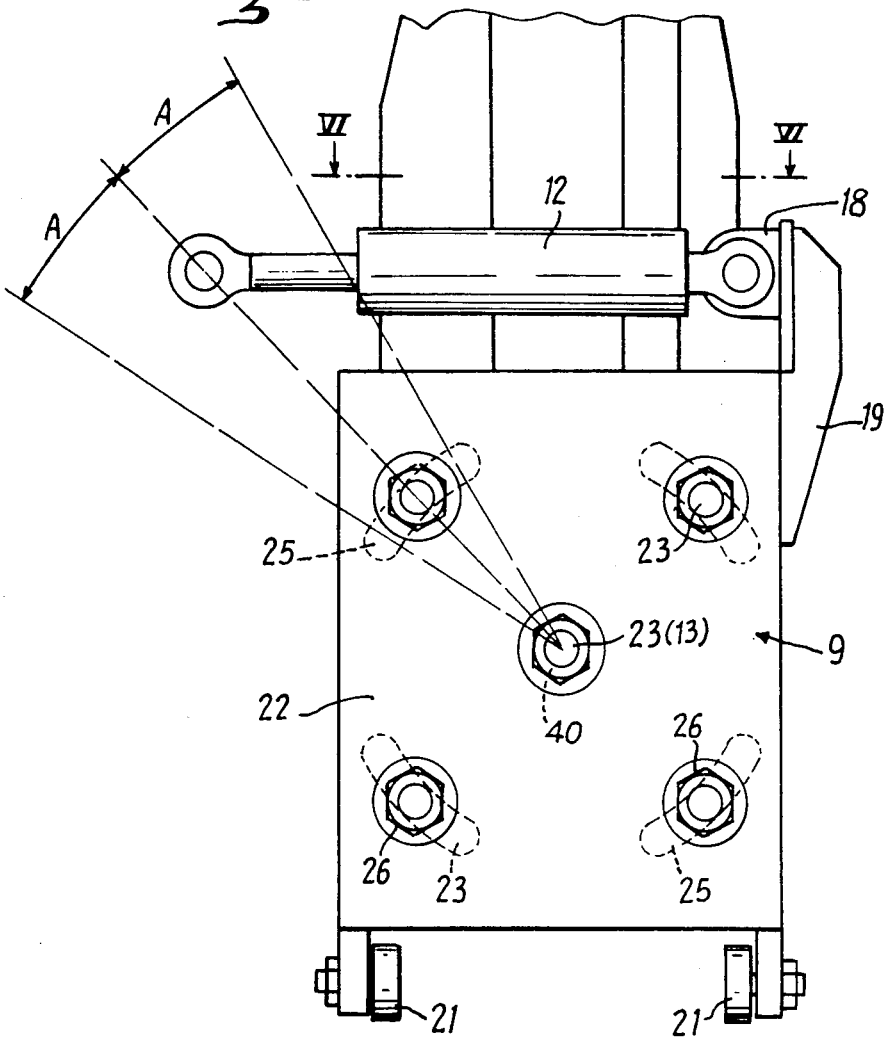
FIG. 5 is a front view of the second means for pivoting the digging wheel.
Figure 6:
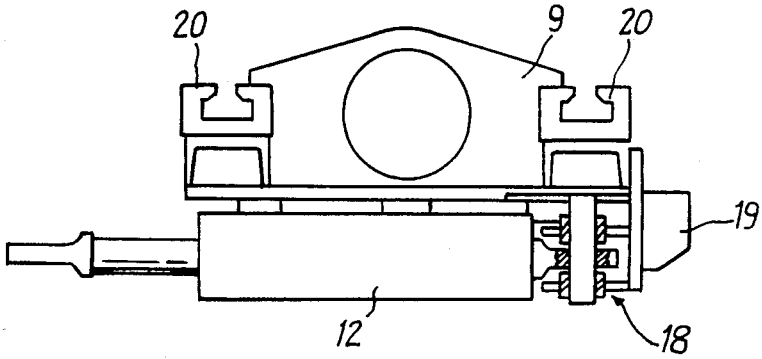
FIG. 6 is sectional view through line VI—VI of FIG. 5.

Furthermore, the hydraulic cylinder 12 is connected to the intermediate piece 14 by a bracket 17 (FIG. 4) and to carriage 9 by a bracket 18 fixed to the carriage by a fixing lug 19 (FIGS. 5 and 6).

Furthermore, the carriage 9 is guided in translation (up and down) on rails 20 having a C shaped cross section and by means of rollers 21.

The front face 22 of carriage 9 is provided with five pins 23 (FIG. 5) and the corresponding plate 24 of the intermediate piece 14 is provided with a central circular hole 40 through which, in the assembled position, the central pin 23 passes playing then the role of second pivoting shaft 13, and four arcuate apertures 25 (through which pass the other four pins 23) allowing the limited pivoting of the intermediate piece 14 with respect to carriage 9 about axis 13. The central holes 40 and their arcuate apertures 25 are shown with broken lines in FIG. 5. The assembly of carriage 9 and the intermediate piece 14 is held in position by nuts 26 each cooperating with the pins 23.

The intermediate piece 14, and therefore wheel 3 may pivot about axis 13 with respect to carriage 9 through a maximum angle A equal, for example, to 14° on each side of an intermediate position (FIG. 5). Likewise, wheel 3 may pivot about axis 11 through a maximum angle B equal for example to 12°, on each side of an intermediate position (FIG. 4).

Furthermore, device 1 includes a hydraulic cylinder 27 (FIG. 2) for moving carriage 9, with its support bracket 28, transversally to the direction of movement F of vehicle 8. The hydraulic cylinder 27 is connected to vehicle 28 by a bracket 29 and to support 28 by a bracket 30. The assembly of carriage 9 and support 28 may thus slide transversally along guide rails 31 having a C cross section.

In this embodiment, the wheel framework 6 has a general L shape a first leg 32 of which is connected to carriage 9 through the first pivoting shaft 11 and the intermediate piece 14 and whose second leg 33 carries the wheel 3. The first 32 and second 33 legs are hinged to each other by a third pivoting shaft 34 parallel to the axis of rotation of wheel 3. Two hydraulic cylinders 36, disposed on each side of wheel 3, connect the remote ends of said first 32 and second 33 legs while being mounted on brackets 36 and 37, respectively, thus capable of raising wheel 3 while causing it to pivot about axis 34.

Finally, to avoid accumulation of earth which would risk fouling, more particularly, the different shafts, the wheel is provided in the vicinity of the whole of its periphery with angularly spaced bores 38.

The device of the invention thus allows the digging wheel to be oriented in space so as always to obtain an even trench perfectly adapted to the laying of cables or similar.

What is claimed is:

1. A device for digging trenches, comprising:

a vehicle, at least one digging wheel, rotating in a wheel framework, an erected, non-tiltable mast assembly, supported by said vehicle and supporting said wheel framework by means of a mobile carriage, for lowering or raising said digging wheel, first means for causing said wheel framework to pivot in a limited way about a first pivoting axis orthogonal to the plane defined by the direction of movement of the vehicle and the axis of rotation of said wheel, and second means capable of causing said wheel framework to pivot in a limited way about a second pivoting axis orthogonal to the plane defined by said first pivoting axis and an axis parallel to the rotational axis of the wheel said wheel framework being connected to said carriage by an intermediate piece hinged, on the one hand, to said wheel framework about said first pivoting axis and fixed, on the other hand, with respect to said carriage, about said second pivoting axis.

2. The device as claimed in claim 1, wherein said digging wheel may pivot about said first and second pivoting axes through a maximum pivoting angle, each time, between about 10° and about 15° on each side of an intermediate position of the wheel.

3. The device as claimed in claim 1, wherein said first pivoting means include a hydraulic cylinder or similar connected both to said wheel framework and to said intermediate piece.

4. The device as claimed in claim 1, wherein said second pivoting means include a hydraulic cylinder or similar connected both to said intermediate piece and to said carriage.

5. The device as claimed in claim 1, further including means for moving said carriage transversally to the direction of movement of said vehicle.

6. The device as claimed in claim 5, wherein said means for moving the carriage transversally include a hydraulic cylinder or similar connected both to said carriage and to said vehicle.

7. A device for digging trenches, comprising:

a vehicle, at least one digging wheel, rotating in a wheel framework, an erected, non-tiltable mast assembly, supported by said vehicle and supporting said wheel framework by means of a mobile carriage, for lowering or raising said digging wheel, first means for causing said wheel framework to pivot in a limited way about a first pivoting axis orthogonal to the plane defined by the direction of movement of the vehicle and the axis of rotation of said wheel, and second means capable of causing said wheel framework to pivot in a limited way about a second pivoting axis orthogonal to the plane defined by said first pivoting axis and an axis parallel to the rotational axis of the wheel, said wheel framework having a general L shape a first leg of which is connected to said carriage through said first pivoting axis and the second leg of which carries the wheel, said first and second legs being hinged to one another through a third pivoting axis parallel to the axis of rotation of the wheel.

8. The device as claimed in claim 7, wherein third pivoting means, formed at least of a hydraulic cylinder or similar, connect together the remot ends of said first and second legs.

9. The device as claimed in claim 1, wherein said wheel is provided, in the vicinity of its whole periphery, with angularly spaced bores.

* * * * *